United States Patent [19]

Shorette

[11] 3,974,584

[45] Aug. 17, 1976

[54] LIGHT ENCLOSURE FOR SUSPENDED CEILING

[76] Inventor: Richard A. Shorette, Crest Road, Monson, Mass. 01057

[22] Filed: Mar. 28, 1975

[21] Appl. No.: 563,150

[52] U.S. Cl. ..... 40/130 R; 40/131 R; 240/9 R

[51] Int. Cl.[2] ..... G09F 13/04

[58] Field of Search ..... 40/130 R, 130 B, 130 G, 40/132 R, 131 A, 131 R, 132 D, 128; 240/9 R, 51.11 R

[56] References Cited

UNITED STATES PATENTS

| | | | |
|---|---|---|---|
| 1,780,373 | 11/1930 | Beuttell | 40/130 C X |
| 2,239,343 | 4/1941 | Rumbaugh | 40/130 G |
| 3,352,071 | 11/1967 | Sutter | 240/9 R X |

FOREIGN PATENTS OR APPLICATIONS

| | | | |
|---|---|---|---|
| 221,644 | 12/1957 | Australia | 40/131 R |
| 1,164,094 | 5/1958 | France | 40/132 R |
| 1,245,305 | 9/1960 | France | 40/132 R |

*Primary Examiner*—John F. Pitrelli

*Attorney, Agent, or Firm*—Chapin, Neal and Dempsey

[57] ABSTRACT

The lighted sign enclosure has a transparent, or translucent hollow body, reaching down from the ceiling, and inside the body a U-shaped fluorescent light tube, extending essentially as far down as the hollow body and back up. The body has a top rim, held on a grid of T-bars or similar bars of the ceiling. It is normally used as a sign, and offers a unique way of displaying symbols, especially pictures.

2 Claims, 2 Drawing Figures

LIGHT ENCLOSURE FOR SUSPENDED CEILING

In department stores and halls with high ceilings, sign boards are often hanging on wires far below the ceiling lights. These signs are hard to read; sometimes they hang above far stronger lights, shining upon stacks of goods, but not on the look-up sign, which directs the visitors. To make the sign better visible by nearby, concentrated light, the invention uses a transparent, hollow body, reaching down from a suspended ceiling. Inside the body a fluorescent light tube extends essentially as far down as the body. The enclosure is held by a top rim, resting on a grid of bars, designed to hold ceiling panels. While the lighted sign usually presents words, to be read from its top downwards, it may be used also to display symbols on its walls. These symbols would be too complicated for imitation by light tubes of shaped glass.

The invention is illustrated in the drawing, without being limited to the shown details.

Figure 1:
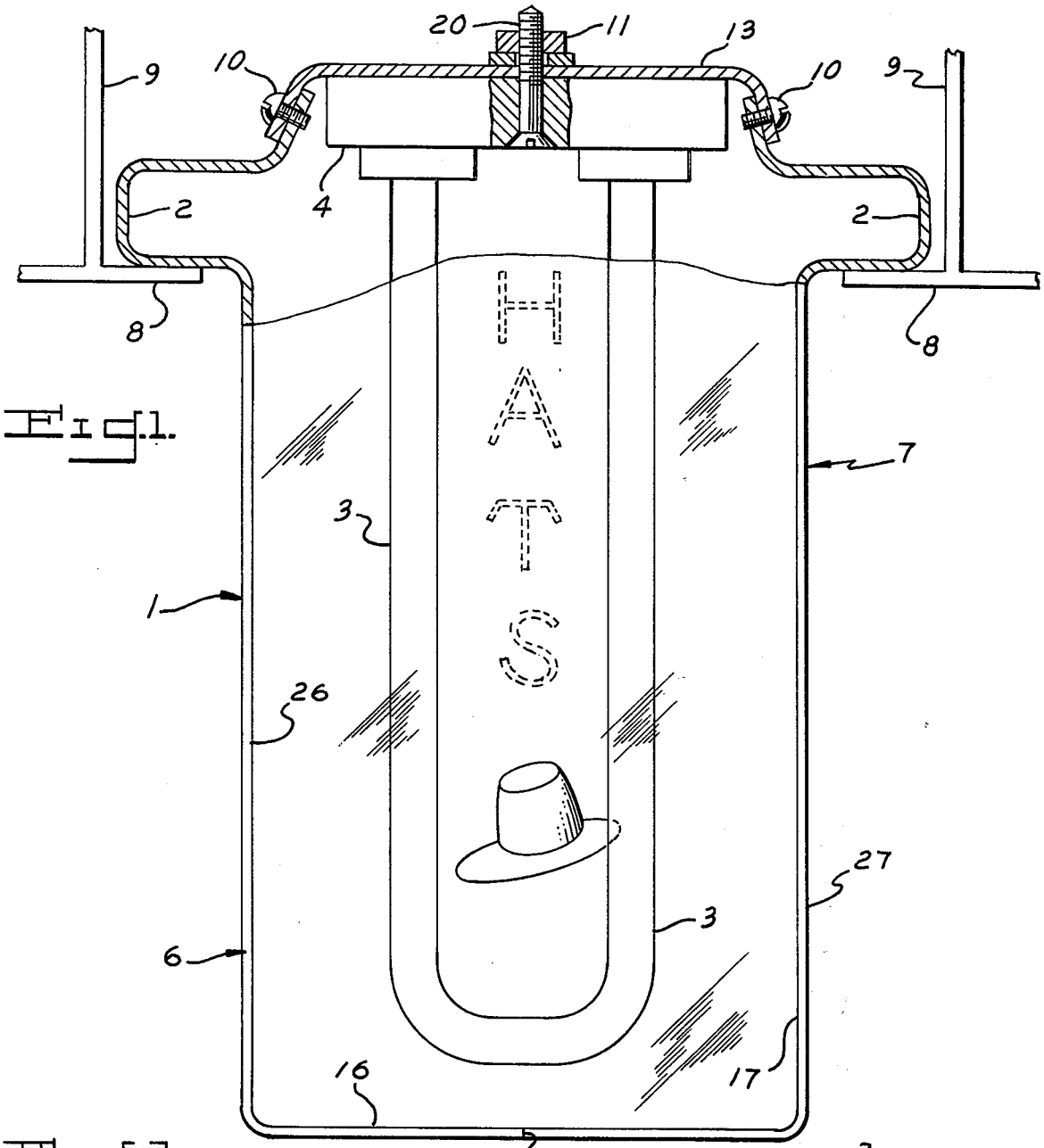
FIG. 1 is a front view of the sign enclosure.

In FIG. 1 the enclosure 1, fitting into an opening between bars 9, rests with its two rectangular, horizontal top rims 2 on flanges 8 of the bars. These T-bars normally support rectangular panels of a suspended ceiling. A panel is lifted out and replaced by the enclosure. The top rims 2 give the enclosure a good measure of stiffness, together with its top 13 that is attached to the assembled body parts 6 and 7 by screws 10. The body is lighted by at least one fluorescent light tube 3 of U-shape, which is attached to a socket 4. This U-shape yields a large radiating surface near the sign in the body. Each body part 6 and 7 may be molded of translucent or transparent plastic.

Figure 2:
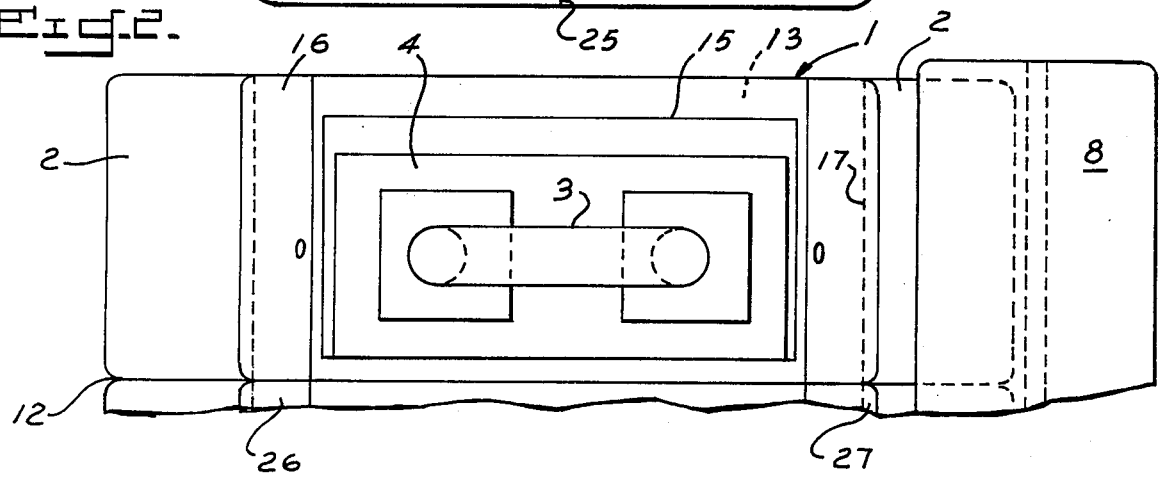
FIG. 2 is a bottom view of half a sign enclosure with the bottom wall removed, to show the inside.

In FIG. 2 only half of the enclosure is shown from below, as the other half is identical. Also only the right hand flange 8 is pictured, while an identical flange is omitted on the left hand side. Each of two sockets 4 may be fastened to the body top 13 by a cement layer 15 and a screw 20 with a nut 11. A bottom split line 25 makes for easier molding of the body half parts 6 and 7, as only one top rim has to be formed on each half part. These halves may be solid, or may be cemented together from body quarters 16, 26 and 17, 27 along the line 12, yet all quarters are held together by the common top 13 and its screws.

As shown the sign displays the word "HATS" and a symbol for a hat, which can be understood without knowledge of English. The symbols on the translucent plastic may be of any suitable design or color appropriate for advertising various products or services.

What I claim is:

1. In combination with a suspended ceiling having ceiling tiles supported on a framework of mutually perpendicular support bars, a unitary, self-contained light diffuser and advertising display comprising a hollow body formed of a translucent sheet material wholly enclosed except for an upwardly directed access opening, said body including an outwardly extending peripheral rim portion adjacent said opening for resting on rectangularly disposed support bars, said hollow body extending a substantial distance downwardly from said rim portion, a tubular light source fitted within said body through said opening and supported therein by a mounting plate affixed to said body adjacent its opening, said tubular light source being in the form of a loop with its lower end in proximity to the lower inner surface of said body, the sheet material forming said body being continuous throughout except for said opening and thereby wholly enclosing said light source and advertising indicia disposed on the surface of said body for illumination by said light source.

2. In combination with a suspended ceiling as set forth in claim 1 wherein said hollow body is formed of two vertically discrete portions bonded together in edge-to-edge relationship, each portion being formed with a portion of said peripheral rim thereon.

* * * * *